United States Patent [19]

Steward

[11] Patent Number: 4,979,456

[45] Date of Patent: Dec. 25, 1990

[54] PORTABLE BLIND

[76] Inventor: Leon D. Steward, P.O. Box 557, Coldwater, Miss. 38618

[21] Appl. No.: 468,580

[22] Filed: Jan. 23, 1990

[51] Int. Cl.[5] ..... B63B 35/86

[52] U.S. Cl. ..... 114/351; 114/361; 135/901

[58] Field of Search ..... 114/15, 351, 361; 135/901

[56] References Cited

U.S. PATENT DOCUMENTS

| | | | |
|---|---|---|---|
| 278,945 | 6/1883 | Hannum | 114/351 |
| 2,816,297 | 12/1957 | Stanley | 114/351 |
| 2,829,660 | 4/1958 | Wester et al. | 114/361 |
| 2,841,159 | 7/1958 | Graham | 135/901 |
| 3,165,111 | 1/1965 | Foster | 114/361 |
| 3,422,829 | 1/1969 | Adams, Jr. | 135/6 |
| 3,698,409 | 10/1972 | Koontz et al. | 135/6 |
| 4,106,145 | 8/1978 | Gillen et al. | 114/351 |
| 4,300,253 | 11/1981 | Anderson | 135/6 |
| 4,473,087 | 9/1984 | Cavender | 135/901 |
| 4,593,641 | 6/1986 | Adams et al. | 114/343 |
| 4,671,203 | 6/1987 | Sanburg | 114/361 |
| 4,683,901 | 8/1987 | Mitchell | 114/361 |
| 4,798,019 | 1/1989 | Sary et al. | 135/901 |

FOREIGN PATENT DOCUMENTS

| | | | |
|---|---|---|---|
| 1459366 | 11/1966 | France | 114/361 |

*Primary Examiner*—Sherman Basinger
*Assistant Examiner*—Thomas J. Brahan
*Attorney, Agent, or Firm*—Walker & McKenzie

[57] ABSTRACT

A boat supported blind including first frame structure having a first frame member for being coupled to the first sidewall of the boat, a second frame member for being coupled to the second sidewall of the boat, and a third frame member for joining the upper ends of the first and second frame members; a second frame structure having a first frame member for being coupled to the first sidewall of the boat, a second frame member for being coupled to the second sidewall of the boat, and a third frame member for joining the upper ends of the first and second frame members; and cover structure for substantially covering the frame structures and the boat. The cover structure includes a first cover member for covering the first frame members of the first and second frame structures, and a second cover member for covering the second frame members and a portion of the third frame members of the first and second frame structures.

17 Claims, 3 Drawing Sheets

FIG. 1
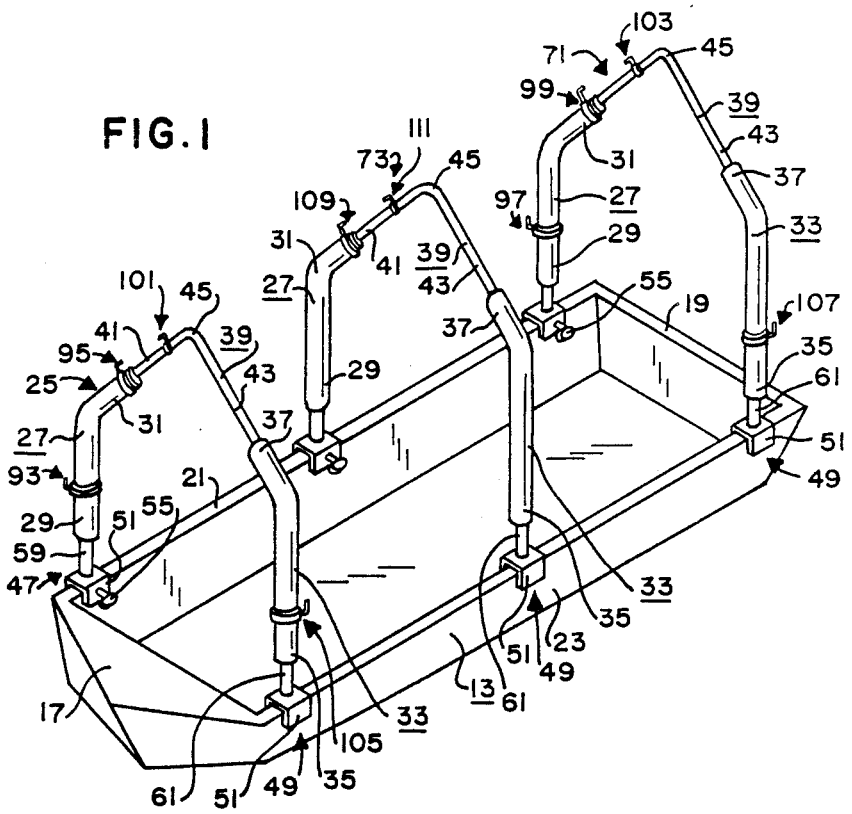
FIG. 2
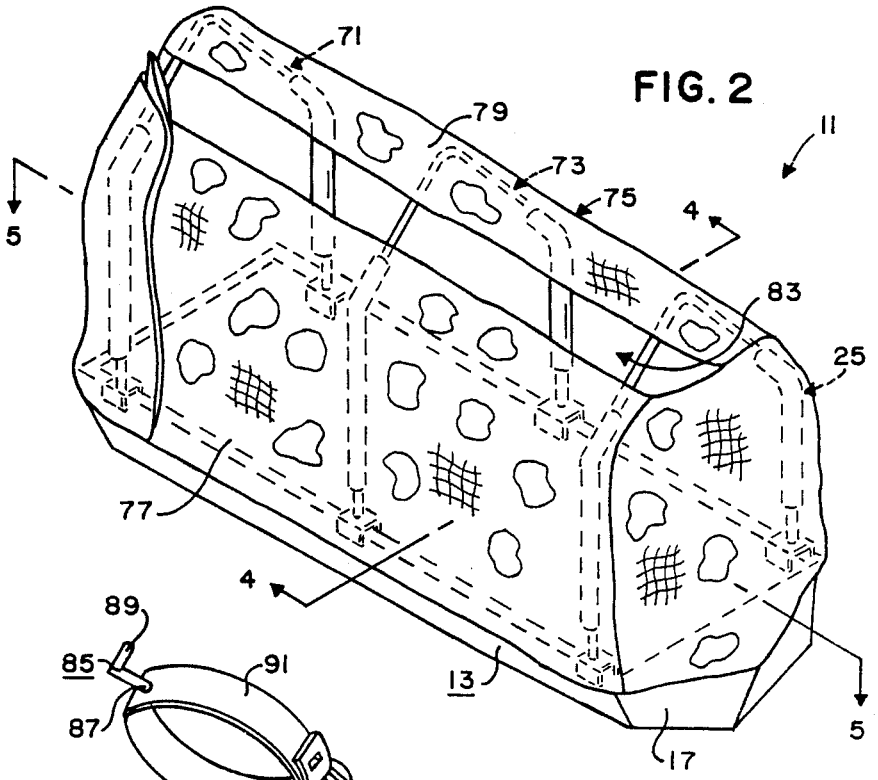
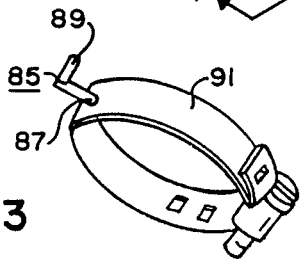
FIG. 3

PORTABLE BLIND

BACKGROUND OF THE INVENTION

1. Field of the Invention

The present invention relates, in general, to portable blinds and more specifically to a boat supported duck blind that can be easily stored in the bottom of the boat for transport to and from a hunting location.

2. Information Disclosure Statement

A preliminary patentability search conducted in class 114, subclasses 343, 351 and 361 produced the following patents: Adams, U.S. Pat. No. 3,422,829; Koontz et al., U.S. Pat. No. 3,698,409; Anderson. U.S. Pat. No. 4,300,253; Adams U.S. Pat. No. 4,593,641; and Sanburg U.S. Pat. No. 4,671,203. Adams, '829 and Koontz et al. disclose covers for boats and thus relate at best only generally to the present invention. Anderson, Adams et al. '641, and Sanburg disclose boat supported duck blinds or the like and thus relate more specifically to the present invention.

However, none of the above patents disclose or suggest the present invention. More specifically, none of the above patents disclose or suggest a blind for being attached to a boat, the blind including first frame means for being coupled to the first and second sidewalls of the boat; the first frame means including a first frame member having a first end for being coupled to the first sidewall of the boat and having a second end, a second frame member having a first end for being coupled to the second sidewall of the boat and having a second end, and a third frame member having a first end for being attached to the second end of the first frame member and having a second end for being attached to the second end of the second frame member; second frame means for being coupled to the first and second sidewalls of the boat; the second frame means including a first frame member having a first end for being coupled to the first sidewall of the boat and having a second end, a second frame member having a first end for being coupled to the second sidewall of the boat and having a second end, and a third frame member having a first end for being attached to the second end of the first frame member and having a second end for being attached to the second end of the second frame member; and cover means for substantially covering the frame means and the boat; the cover means including a first cover member for covering the first frame members of the first and second frame means, and a second cover member for covering the second frame members of the first and second frame means and a substantial portion of the third frame members of the first and second frame means.

SUMMARY OF THE INVENTION

The present invention is directed toward providing an improved portable blind. The concept of the present invention is to provide a duck blind that can be adjusted to be attached to many different size and style boats, that can be stored in the bottom of a boat, and that can be easily and quickly assembled and disassembled.

The blind of the present invention includes first frame means for being coupled to the first and second sidewalls of a boat; the first frame means including a first frame member having a first end for being coupled to the first sidewall of the boat and having a second end, a second frame member having a first end for being coupled to the second sidewall of the boat and having a second end, and a third frame member having a first end for being attached to the second end of the first frame member and having a second end for being attached to the second end of the second frame member; second frame means for being coupled to the first and second sidewalls of the boat, the second frame means including a first frame member having a first end for being coupled to the first sidewall of the boat and having a second end, a second frame member having a first end for being coupled to the second sidewall of the boat and having a second end, and a third frame member having a first end for being attached to the second end of the first frame member and having a second end for being attached to the second end of the second frame member; and cover means for substantially covering the frame means and the boat; the cover means including a first cover member for covering the first frame members of the first and second frame means, and a second cover member for covering the second frame members of the first and second frame means and a substantial portion of the third frame members of the first and second frame means.

BRIEF DESCRIPTION OF THE DRAWINGS

FIG. 1 is a perspective view of a boat with frame means of the blind of the present invention mounted thereon.

FIG. 2 is a perspective view of the blind of the present invention shown mounted on a boat.

FIG. 3 is a perspective view of an attachment means of the blind of the present invention.

DESCRIPTION OF THE PREFERRED EMBODIMENT

Figure 4:
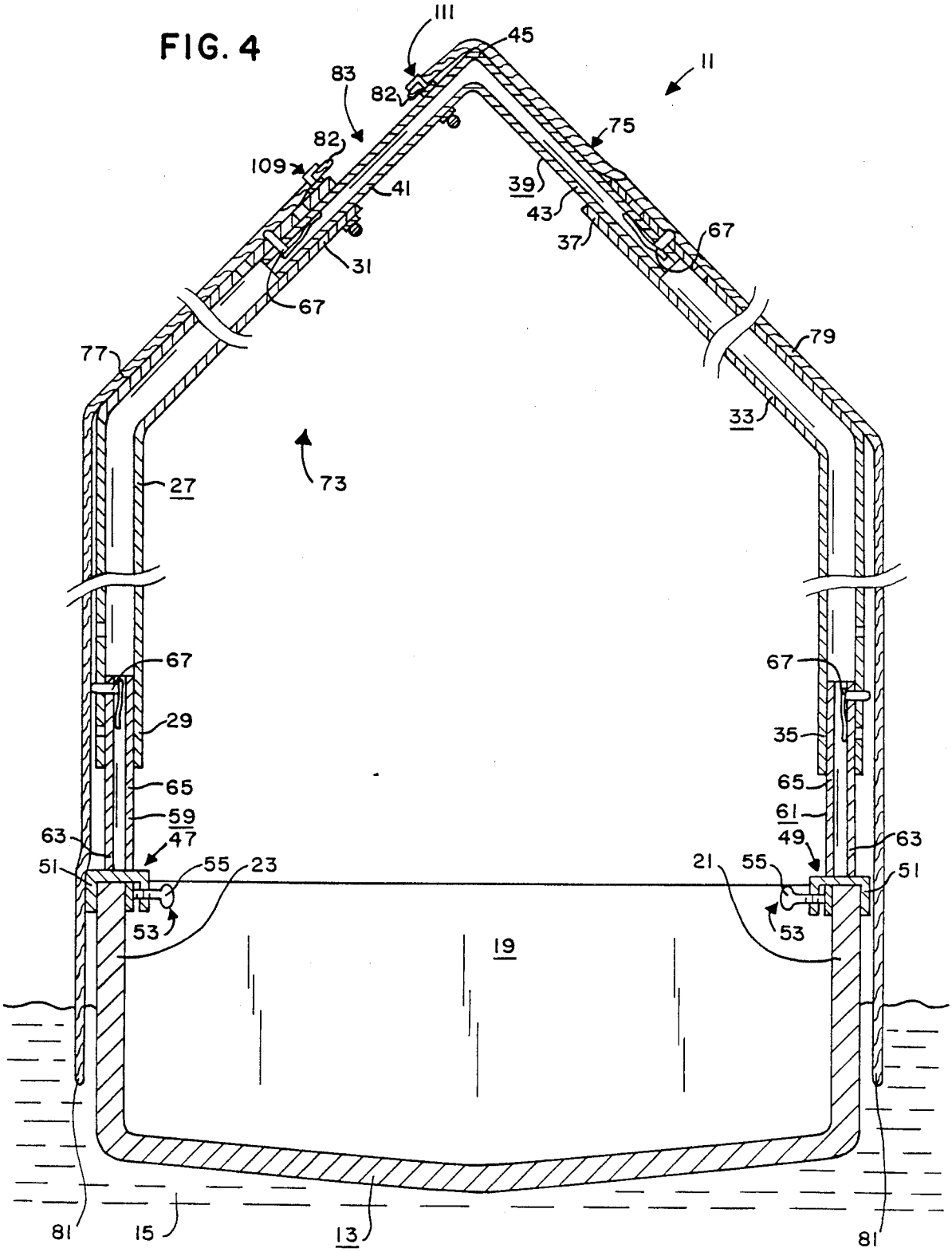
FIG. 4 is an enlarged sectional view substantially as taken on line 4—4 of FIG. 2 with certain portions broke away for clarity.
Figure 5:
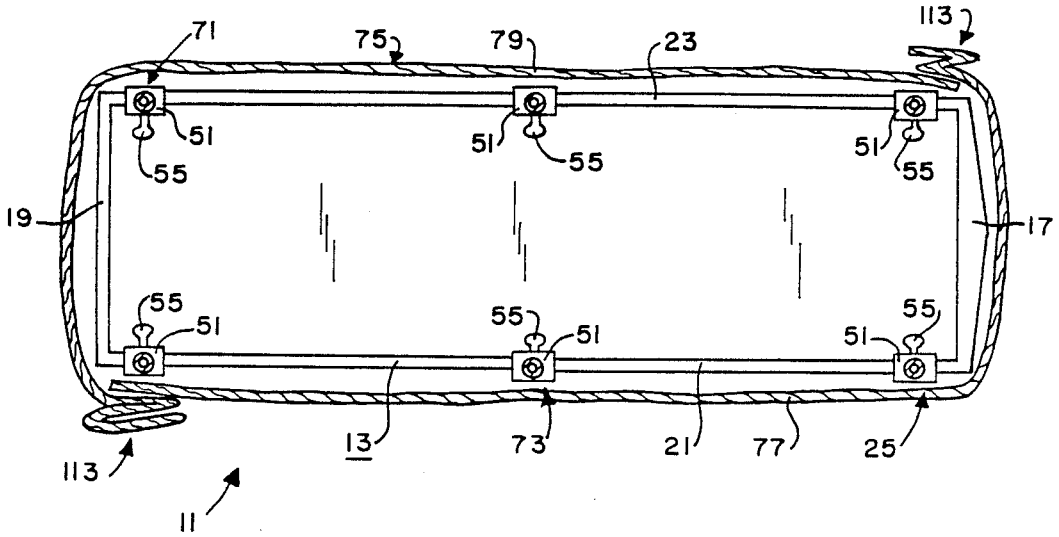
FIG. 5 is a sectional view substantially as taken on line 5—5 of FIG. 2.
Figure 6:
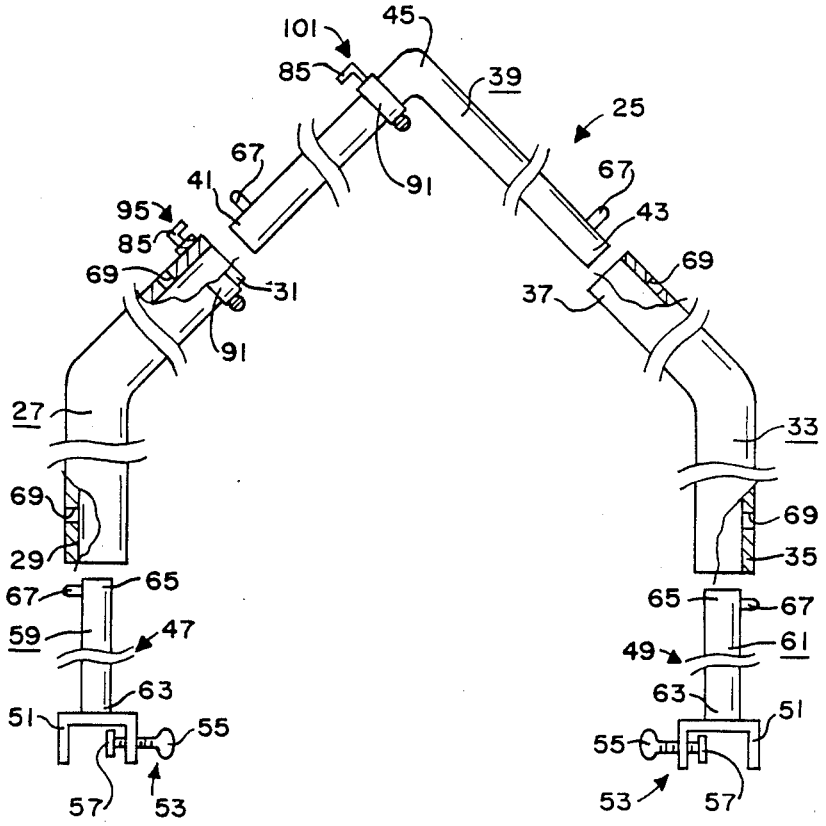
FIG. 6 is an exploded view of a frame means and certain attachment means of the blind of the present invention.

The blind 11 of the present invention is for use with a boat 13 to float on a body of water 15. The boat 13 may be of any typical construction and size, including a first end 17, a second end 19, a first sidewall 21, and a second sidewall 23. Thus, the boat 13 may be a typical substantially flat bottom "jon" boat used by many hunters for duck hunting and the like.

The blind 11 includes first frame means 25 for being coupled to the first and second sidewalls 21, 23 of the boat 13. The first frame means 25 includes a first frame member 27 having a first end 29 for being coupled to the first sidewall 21 of the boat 13 and having a second end 31. The first frame member 27 is preferably shaped so that the second end 31 thereof slopes inwardly from a point between the first and second ends 29, 31 thereof The first frame member 27 may be constructed out of an elongated piece of light-weight pipe or the like. The first frame means 25 includes a second frame member 33 having a first end 35 for being coupled to the second sidewall 23 of the boat 13 and having a second end 37. The second frame member 33 is preferably shaped so that the second end 37 thereof slopes inwardly from a point between the first and second ends 35, 37 thereof. The second frame member 33 may also be constructed out of an elongated piece of light-weight pipe or the like in a substantial mirror-image of the first frame member 27. The first frame means 25 includes a third frame member 39 having a first end 41 for being attached to the second end 31 of the first frame member 27 and having a second end 43 for being attached to the second end 37 of the second frame member 33. The third frame member 39 is preferably shaped so that ends 41 43 thereof slope downwardly from the midportion thereof to thus form an ape 45 at the midportion thereof. The third frame member 39 may also be constructed out of an elongated piece of light-weight pipe or the like. The first frame means 25 is preferably mounted on the boat 13 at a location substantially adjacent the first end 17 thereof transverse to the longitudinal axis of the boat 13 as clearly shown in FIG. 1. The ends 41, 43 of the third frame member 39 are preferably sized so as to slidably fit into the respective ends 31, 37 of the first and second frame members 27, 33 in a telescopic manner to allow the distance between the first and second frame members 27, 33 to be varied and to thus accommodate boats of different widths, or to be attached to different locations along the length of the boat 13, etc., as will now be apparent to those skilled in the art.

The first frame means 25 preferably includes first clamp means 47 for removably clamping the first end 29 of the first frame member 27 to the first sidewall 21 of the boat 13, and second clamp means 49 for removably clamping the first end 35 of the second frame member 33 to the second sidewall 23 of the boat 13. Each of the clamp means 47, 49 preferably includes a U-shaped bracket 51 for fitting over the upper end or gunwale of the respective sidewall 21, 23 of the boat 13. Each clamp means 47, 49 preferably includes means such as screw means 53 for attaching the U-shaped bracket 51 to the respective sidewall 21, 23 of the boat 13. Each screw means 53 preferably includes a screw 55 for extending through a threaded aperture in the U-shaped bracket 51 of the respective clamp means 47, 49. Further, each screw means 53 preferably includes a plate member 57 attached to the distal end of the associated screw 55 for engaging the respective sidewall 21, 23 of the boat 13.

The first frame means preferably includes a first post member 59 for joining the first clamp means 47 to the first frame member 27, and a second post member 61 for joining the second clamp means 49 to the second frame member 33. Each post member 59, 61 has a lower end 63 attached to the U-shaped bracket 51 of the respective clamp means 47, 49 and an upper end 65 for being coupled to the first end 29, 35 of the respective frame member 27, 33. Each post member 59, 61 may be constructed out of an elongated piece of light-weight pipe or the like with the lower end 63 welded or otherwise securely attached to the respective U-shaped bracket 51 and with the upper end 65 sized so as to slidably fit into the first end 29, 35 of the respective frame member 27, 33 in a telescopic manner to allow the height of the first frame means 25 to be varied as will now be apparent to those skilled in the art.

The first frame means 25 preferably includes securing means for adjustably securing the first ends 29, 35 of the frame members 27, 33 to the upper ends 65 of the respective post members 59, 61 and the second ends 31, 37 to the respective ends 41, 43 of the third frame member 39. The securing means preferably includes typical spring-type detent members 67 positioned adjacent the upper ends 65 of the post members 59, 61 and the ends 41, 43 of the third frame member 39 for engaging one of a plurality of spaced apertures 69 through the frame members 27, 33 to allow easy adjustment of the height and width of the frame means 25 as will now be apparent to those skilled in the art.

The blind 11 includes second frame means 71 for being coupled to the first and second sidewalls 21, 23 of the boat 13. The second frame means 71 is preferably mounted on the boat 13 at a location substantially adjacent the second end 19 thereof transverse to the longitudinal axis of the boat 13 as clearly shown in FIG. 1. The second frame means 71 is preferably identical to the first frame means 25 and the above description of the first frame means 25 should be consulted for a thorough description of the individual elements of the second frame means 71. For clarity, like elements of the first and second frame means 25, 71 are identified with the same reference numerals in the drawings, etc.

The blind 11 preferably includes one or more intermediate frame means 73 for being coupled to the first and second sidewalls 21, 23 of the boat 13. Each intermediate frame means 73 is preferably mounted on the boat 13 at a location between the first and second ends 17, 19 thereof transverse to the longitudinal axis of the boat 13 as clearly shown in FIG. 1. Each intermediate frame means 73 is preferably identical to the first and second frame means 25, 71 and the above description of the first frame means 25 should be consulted for a through description of the individual elements of the intermediate frame means 73. For clarity, like elements of the first, second and intermediate frame means 25, 71, 73 are identified with the same reference numeral in the drawings, etc.

The blind 11 includes cover means 75 for substantially covering the frame means 25, 71, 73 and the boat 13. The cover means 75 preferably includes a first cover member 77 for substantially covering the first frame members 27 of the frame means 25, 71, 73, and a second a second cover member 79 for substantially covering the second frame members 33 of the frame means 25, 71, 73 and a substantial portion of the third frame members 39 of the frame means 25, 71, 73. The first cover member 77 is preferably designed to substantially cover the first end 17 of the boat 13 and the second cover member 79 is preferably designed to substantially cover the second end 19 of the boat 13. The first cover member 77 preferably consists of a substantially rectangular first piece of camouflaged burlap having a length and a width. The second cover member 79 preferably consists of a substantially rectangular second piece of camouflaged burlap having a length and a width. The length of the first piece of burlap is preferably substantially the same as the length of the second piece of burlap while the width of the first piece of burlap is preferably less than the width of the second piece of burlap. The lower edges 81 of the first and second cover members 77, 79 preferably extend into the body 15 of water when the cover members 77, 79 are properly attached to the frame means 25, 71, 73 so that a certain amount of water will be absorbed by the lower edges 81 to increase the weight of the lower edges 81 and stretch the cover members 77, 79 downward as will now be apparent to those skilled in the art. The upper edges 82 of the first and second cover members 77, 79 are spaced from one another a certain distance to form a slit 83 or the like to allow the user of the blind 11 to see out of, etc., as will now be apparent to those skilled in the art. While the size and shape of the cover means 75 may vary, for a typical 14 foot boat, the first cover member 77 may be 18 feet long and 4 feet wide while the second cover member 79 may be 18 feet long and 6.5 feet wide.

The blind 11 preferably includes a plurality of attachment means for attaching the cover means 75 to the frame means 25, 71, 73. Each of the attachment means preferably includes a hook 85 having a first end 87 for being attached to one of the frame means 25, 71, 73 at a strategic location and having a second end 89 for extending through the cover means 75 to thus secure the cover means 75 to the frame means 25, 71, 73. The second end 89 of the hook 85 of each of the attachment means is preferably bent at an angle to the first end 87 thereof to secure the cover means 75 to the frame means 25, 71, 73 as will now be apparent to those skilled in the art. Each attachment means preferably includes collar means 91 for being movably fastened to one of the frame means 25, 71, 73. The collar means 91 is preferably adjustable and may consist of a typical radiator hose clamp of any well known construction now apparent to those skilled in the art with the first end 87 of the associated hook 85 welded or otherwise securely attached thereto. The locations of the attachment means are critical to the proper operation of the blind 11. Thus, the plurality of attachment means preferably includes first attachment means 93 for being attached to the first frame member 27 of the first frame means 25 adjacent the first end 29 thereof, second attachment means 95 for being attached to the first frame member 27 of the first frame means 25 adjacent the second end 31 thereof; third attachment means 97 for being attached to the first frame member 27 of the second frame means 71 adjacent the first end 29 thereof, fourth attachment means 99 for being attached to the first frame member 27 of the second frame means 71 adjacent the second end 31 thereof, fifth attachment means 101 for being attached to the third frame member 39 of the first frame means 25 adjacent the first end 41 thereof, sixth attachment means 103 for being attached to the third frame member 39 of the second frame means 71 adjacent the first end 41 thereof, seventh attachment means 105 for being attached to the second frame member 33 of the first frame means 25 adjacent the first end 35 thereof, eighth attachment means 107 for being attached to the second frame member 33 of the second frame means 71 adjacent the first end 35 thereof, ninth attachment means 109 attached to the first frame member 27 of the intermediate frame means 73 adjacent the second end 31 thereof, and tenth attachment means 111 attached to the third frame member 39 of the intermediate frame means 73 adjacent the first end 41 thereof (see, in general, FIG. 1). Folds 113 or the like may be formed in the cover members 77, 79 at opposite corners of the boat 13 when the cover members 77, 79 are attached to the attachment means. Thus, the cover member 77 may be folded with three layers thereof being secured by the seventh attachment means 105. Likewise, the cover member 79 may be folded with three layers thereof being secured by the third and fourth attachment means 97, 99.

Although the present invention has been described and illustrated with respect to a preferred embodiment and a preferred use therefor, it is not to be so limited since modifications and changes can be made therein which are within the full intended scope of the invention.

I claim:

1. A blind for being attached to a boat for floating on a body of water; said boat having first and second ends and first and second sidewalls, said blind comprising:

(a) first frame means for being coupled to said first and second sidewalls of said boat, said first frame means including a first frame member having a first end for being coupled to said first sidewall of said boat and having a second end; said first frame means including a second frame member having a first end for being coupled to said second sidewall of said boat and having a second end; said first frame means including a third frame member having a first end for being attached to said second end of said first frame member and having a second end for being attached to said second end of said second frame member;

(b) second frame means for being coupled to said first and second sidewalls of said boat, said second frame means including a first frame member having a first end for being coupled to said first sidewall of said boat and having a second end; said second frame means including a second frame member having a first end for being coupled to said second sidewall of said boat and having a second end; said second frame means including a third frame member having a first end for being attached to said second end of said first frame member and having a second end for being attached to said second end of said second frame member, said second frame means being substantially identical to said first frame means; and (c) cover means for substantially covering said frame means and said boat; said cover means including a first cover member for covering said first frame members of said first and second frame means; said cover means including a second cover member for covering said second frame members of said first and second frame means and a substantial portion of said third frame members of said first and second frame means; said first cover member having a length and a width; said second cover member having a length and a width; said width of said first cover member being less than the width of said second cover member.

2. The blind of claim 1 in which said first cover member substantially covers said first end of said boat; and in which said second cover member substantially covers said second end of said boat.

3. A blind for being attached to a boat for floating on a body of water; said boat having first and second ends and first and second sidewalls, said blind comprising:

(a) first frame means for being coupled to said first and second sidewalls of said boat, said first frame means including a first frame member having a first end for being coupled to said first sidewall of said boat and having a second end; said first frame means including a second frame member having a first end for being coupled to said second sidewall of said boat and having a second end; said first frame means including a third frame member having a first end for being attached to said second end of said first frame member and having a second end for being attached to said second end of said second frame member;

(b) second frame means for being coupled to said first and second sidewalls of said boat, said second frame means including a first frame member having a first end for being coupled to said first sidewall of said boat and having a second end; said second frame means including a second frame member having a first end for being coupled to said second sidewall of said boat and having a second end; said second frame means including a third frame member having a first end for being attached to said second end of said first frame member and having a second end for being attached to said second end of said second frame member; and (c) cover means for substantially covering said frame means and said boat; said cover means including a first cover member for covering said first frame members of said first and second frame means; said cover means including a second cover member for covering said second frame members of said first and second frame means and a substantial portion of said third frame members of said first and second frame means; said first cover member substantially covering said first end of said boat; said second cover member substantially covering said second end of said boat; said first cover member including a substantially rectangular piece of burlap having a length and a width; said second cover member including a substantially rectangular piece of burlap having a length and a width; said length of said first piece of burlap being substantially the same as said length of said second piece of burlap; said width of said first piece of burlap being less than the width of said second piece of burlap.

4. The blind of claim 3 in which an edge of said first and second pieces of burlap extends into said body of water when said cover means is positioned on said frame means.

5. A blind for being attached to a boat having a first and second sidewalls, said blind comprising:

(a) first frame means for being coupled to said first and second sidewalls of said boat, said first frame means including a first frame member having a first end for being coupled to said first sidewall of said boat and having a second end; said first frame means including a second frame member having a first end for being coupled to said second sidewall of said boat and having a second end; said first frame means including a third frame member having a first end for being attached to said second end of said first frame member and having a second end for being attached to said second end of said second frame member, said third frame member having an apex located midway between and higher than said first and second ends of said third frame member;

(b) second frame means for being coupled to said first and second sidewalls of said boat, said second frame means including a first frame member having a first end for being coupled to said first sidewall of said boat and having a second end; said second frame means including a second frame member having a first end for being coupled to said second sidewall of said boat and having a second end; said second frame means including a third frame member having a first end for being attached to said second end of said first frame member and having a second end for being attached to said second end of said second frame member, said third frame member having an apex located midway between and higher than said first and second ends of said third frame member;

(c) cover means for substantially covering said frame means and said boat, said cover means including a first portion for covering said first frame members of said first and second frame means, said cover means including a second portion for covering said second frame members of said first and second frame means and a substantial portion of said third frame members of said first and second frame means, said first and second portions of said cover means having an upper edge and a lower edge; and (d) a plurality of attachment means for attaching said cover means to said frame means; each of said attachment means including a hook having a first end for being attached to one of said frame means and having a second end for extending through said cover means; said second end of said hook of each of said attachment means being bent at an angle to said first end thereof to secure said cover means to said frame means, at least one of said attachment means being attached adjacent said second end of said first frame member of said first and second frame means for attaching said upper edge of said first portion of said cover means thereto, at least one of said attachment means being attached to said third frame member of said first and second frame means at a location between said first end thereof and said apex thereof for attaching said upper edge of said second portion of said cover means thereto.

6. The blind of claim 5 in which each of said attachment means includes collar means for being movably fastened to one of said frame means.

7. The blind of claim 5 in which said plurality of attachment means includes first attachment means for being attached to said first frame member of said first frame means adjacent said first end thereof, second attachment means for being attached to said first frame member of said first frame means adjacent said second end thereof; third attachment means for being attached to said first frame member of said second frame means adjacent said first end thereof, fourth attachment means for being attached to said first frame member of said second frame means adjacent said second end thereof, fifth attachment means for being attached to said third frame member of said first frame means adjacent said first end thereof, sixth attachment means for being attached to said third frame member of said second frame means adjacent said first end thereof, seventh attachment means for being attached to said second frame member of said first frame means adjacent said first end thereof, and eighth attachment means for being attached to said second frame member of said second frame means adjacent said first end thereof.

8. The blind of claim 7 in which is included intermediate frame means for being coupled to said first and second sidewalls of said boat, said intermediate frame means including a first frame member having a first end for being coupled to said first sidewall of said boat and having a second end; said intermediate frame means including a second frame member having a first end for being coupled to said second sidewall of said boat and having a second end; said intermediate frame means including a third frame member having a first end for being attached to said second end of said first frame member and having a second end for being attached to said second end of said second frame member.

9. The blind of claim 8 in which said plurality of attachment means includes ninth attachment means for being attached to said first frame member of said intermediate frame means adjacent said second end thereof, and includes tenth attachment means for being attached to said third frame member of said intermediate frame means adjacent said first end thereof.

10. A blind for being attached to a boat having a first and second sidewalls, said blind comprising;

(a) first frame means for being adjustably and removably coupled to said first and second sidewalls of said boat, said first frame means including a first frame member having a first end for being adjustably and removably coupled to said first sidewall of said boat and having a second end; said first frame means including a second frame member having a first end for being adjustably and removably coupled to said second sidewall of said boat and having a second end; said first frame means including a third frame member having a first end for being adjustably and removably attached to said second end of said first frame member and having a second end for being adjustably and removably attached to said second end of said second frame member; said first frame means being vertically and horizontally adjustable for allowing the height and width thereof to be varied;

(b) second frame means for being adjustably and removably coupled to said first and second sidewalls of said boat, said second frame means including a first frame member having a first end for being adjustably and removably coupled to said first sidewall of said boat and having a second end; said second frame means including a second frame member having a first end for being adjustably and removably coupled to said second sidewall of said boat and having a second end; said second frame means including a third frame member having a first end for being adjustably and removably attached to said second end of said first frame member and having a second end for being adjustably and removably attached to said second end of said second frame member; said second frame means being vertically and horizontally adjustable for allowing the height and width thereof to be varied; and (c) cover means for removably covering said frame means and said boat; said cover means including a first cover member for covering said first frame members of said first and second frame means; said cover means including a second cover member for covering said second frame members of said first and second frame means and a substantial portion of said third frame members of said first and second frame means; said first cover member having a length and a width; said second cover member having a length and a width; said width of said first cover member being less than the width of said second cover member.

11. The blind of claim 10 in which said first frame means includes first clamp means for removably clamping said first end of said first frame member of said first frame means to said first sidewall of said boat, and second clamp means for removably clamping said first end of said second frame member of said first frame means to said second sidewall of said boat; and in which said second frame means includes first clamp means for removably clamping said first end of said first frame member of said second frame means to said first sidewall of said boat, and second clamp means for removably clamping said first end of said second frame member of said second frame means to said second sidewall of said boat.

12. The blind of claim 11 in which each of said clamp means includes a U-shaped bracket for fitting over the upper end of the respective one of said sidewalls of said boat, and includes screw means for securing said U-shaped bracket to the respective one of said sidewalls of said boat.

13. The blind of claim 12 in which said screw means of each of said clamp means includes a screw for being threadingly attached to said U-shaped bracket of the respective one of said clamp means and includes a plate member for engaging the respective one of said sidewalls of said boat.

14. The blind of claim 12 in which each of said clamp means includes an elongated post member for being telescopically associated with said first end of the respective one of said frame members.

15. The blind of claim 14 in which said first end of said third frame member of said first frame means is telescopically associated with said second end of said first frame member of said first frame means; in which said second end of said third frame member of said first frame means is telescopically associated with said second end of said second frame member of said first frame means; in which said first end of said third frame member of said second frame means is telescopically associated with said second end of said first frame member of said second frame means; and in which said second end of said third frame member of said second frame means is telescopically associated with said second end of said second frame member of said second frame means.

16. The blind of claim 15 in which each of said ends of said third frame member of each of said frame means slopes downwardly from the midportion thereof.

17. A blind for being attached to a boat for floating on a body of water; said boat having first and second ends and first and second sidewalls, said blind comprising:

(a) frame means for being coupled to said first and second sidewalls of said boat, said frame means including a first frame member having a first end for being coupled to said first sidewall of said boat and having a second end; said frame means including a second frame member having a first end for being coupled to said second sidewall of said boat and having a second end; said frame means including a third frame member having a first end for being attached to said second end of said first frame member and having a second end for being attached to said second end of said second frame member; and (b) cover means for substantially covering said frame means and said boat; said cover means including a first cover member for substantially covering said first end of said boat and for covering said first frame member of said frame means; said cover means including a second cover member for substantially covering said second end of said boat and for covering said second frame member of said frame means and a substantial portion of said third frame member of said frame means; said first cover member including a substantially rectangular piece of material having a length and a width; said second cover member including a substantially rectangular piece of material having a length and a width; said length of said first piece of material being substantially the same as said length of said second piece of material; said width of said first piece of material being less than the width of said second piece of material.

* * * * *